US008166790B2

(12) United States Patent
Russell et al.

(10) Patent No.: US 8,166,790 B2
(45) Date of Patent: May 1, 2012

(54) CONTINUOUS METAL EXTRUDER

(75) Inventors: Derek William Russell, Aspa Bruk (SE); Kenneth Henning Runo Gustafsson, Motala (SE); Bo Anders Persson, Vreta Kloster (SE)

(73) Assignee: H. Folke Sandelin AB, Motala (SE)

( * ) Notice: Subject to any disclaimer, the term of this patent is extended or adjusted under 35 U.S.C. 154(b) by 526 days.

(21) Appl. No.: 12/068,175

(22) Filed: Feb. 4, 2008

(65) Prior Publication Data

US 2009/0196947 A1 Aug. 6, 2009

(51) Int. Cl.
*B21C 23/00* (2006.01)
*B29C 47/00* (2006.01)

(52) U.S. Cl. ..... 72/253.1; 425/376.1; 425/380

(58) Field of Classification Search ..... 72/253.1, 72/262; 425/190, 192 R, 376.1, 380.381; 264/171.29, 209.2

See application file for complete search history.

(56) References Cited

U.S. PATENT DOCUMENTS

| | | | | |
|---|---|---|---|---|
| 2,051,688 A | | 2/1933 | Dunsheath | |
| 2,172,651 A | | 5/1937 | Dunsheath | |
| 2,427,960 A | * | 9/1947 | Griffiths | 72/262 |
| 3,693,394 A | | 9/1972 | Runevall et al. | |

FOREIGN PATENT DOCUMENTS

| | | |
|---|---|---|
| GB | 429918 | 6/1935 |
| GB | 430006 | 6/1935 |

* cited by examiner

*Primary Examiner* — Teresa Ekiert
(74) *Attorney, Agent, or Firm* — Harness, Dickey & Pierce, P.L.C.

(57) ABSTRACT

Example embodiments relate to a continuous metal extruder that includes a rotatable member having an extrusion screw portion for transporting metal to be extruded in an axial direction of the rotatable member, a fixed part, a spring element for biasing the rotatable member and the fixed part in relation to each other, and a thrust bearing arranged between the rotatable member and the fixed part.

9 Claims, 3 Drawing Sheets

CONTINUOUS METAL EXTRUDER

TECHNICAL FIELD

The present invention relates to continuous metal extruders comprising a rotatable screw to transport the metal and a thrust bearing to support the screw during extrusion.

BACKGROUND

A today predominant continuous metal extruding machine, or simply metal extruder, of rotary extrusion type, well known in the art, is manufactured by the company H. Folke Sandelin® and marketed under the trademark HANSSON-ROBERTSON®.

U.S. Pat. No. 3,693,394 discloses one example of a HANSSON-ROBERTSON® type of metal extruder. A conventional HANSSON-ROBERTSON® machine comprises a main motor, a gear box, an extrusion screw, a screw housing, screw bearings, a bearing housing, a die block, temperature control means, a melting pot and a feed pipe. The main motor and gear box are arranged to drive and rotate the extrusion screw inside the screw housing. The screw is rotatably supported in the bearing housing and extends from the bearing housing towards the die block. Melted metal is arranged to be fed, via the feed pipe, into the screw housing to fill spaces between the outer surface of the screw and the inner surfaces of the screw housing. The temperature control means enables control of the temperature of the metal in the screw housing, i.a. so that it can be transported by the screw (typically be keeping the metal in plastic state), and to allow for control of the extrusion process, and thereby, in the end, also quality of the extruded product. The rotation of the screw transports the metal towards the die block under high pressure and the screw terminates at an inlet to the die block. For extrusion into cable sheet, the die block comprises means for turning the flow of the metal, typically plastic lead, 90-degrees, so that the flow direction becomes substantially perpendicular to the axial (metal transport or extrusion) direction of the screw, thereby enabling forming the cable sheet onto a cable being transported in the perpendicular direction through the die block.

Extrusion of metals requires considerably pressure to force the metal through the die block in a desirable manner. For example, in the case of lead extrusion, the pressure is in the order of 1700 atmospheres, and in the case of aluminum, in the order of about 5000 atmospheres. For operation of the machine at such high pressure, the extrusion screw of a HANSSON-ROBERTSON® extruder is axially supported by a thrust bearing in the bearing housing, typically arranged in the axial direction between a radial protrusion of the screw and the bearing housing. Such thrust bearing is e.g. shown in FIG. 1 of U.S. Pat. No. 3,693,394.

Hitherto, all HANSSON-ROBERTSON® type of machines have been designed to be vertically oriented during operation, i.e. so that the screw extends vertically, i.e. aligned with gravity, with the metal being transported upwards. However, one problem with a vertical oriented machine is that a large part of the machine, e.g. the motor, gearbox, bearing housing, and a large part of the screw and screw housing, have to be placed below floor level in the production plant where the machine is to be operated. Reason for this is that it is desirable, or even required, to have the die block and the output of the extruded product at a level not too far above the floor level of the plant. As a result, a costly, both in time and money, deep foundation has to be prepared in the floor of the plant before a machine can be installed.

SUMMARY OF INVENTION

During redesign of a conventional vertically oriented HANSSON-ROBERTSON® type of extruder into a horizontally oriented extruder, in order to solve the aforementioned problem, it was found that a conventional thrust bearing arrangement caused problems. For example, it was i.a. found that the extrusion screw could not be supported properly by the thrust bearing in non-extrusion situations and that the thrust bearing parts could separate during assembly of the extruder and in other situations of non-extrusion. One explanation to the problems is that gravity acts radially, instead of axially, upon the screw in the horizontal extruder. Without any extrusion pressure, only radial gravitational forces act upon the screw. As a result, the thrust bearing becomes unbiased at non-extrusion and cannot support the screw. It was also found that the distance between surfaces arranged to be in contact with the thrust bearing races changed between situations of different temperatures in the bearings housing. In this type of extruder the temperature in the bearing housing changes naturally, typically from several hundred degrees Celsius directly after extrusion has stopped, to room temperature after a longer period of stop. At these temperatures, there are differences in expansion/contraction between the thrust bearing and the parts interacting with it. As a result, a certain play is formed, within which the thrust bearing is movable and thus undesirably can separate.

A general object of the invention is thus to present a solution that enables provision of a horizontally arranged continuous metal extruder based on the conventional vertically oriented HANSSON-ROBERTSON® type of machine. A more specific object is to present a solution that solve the aforementioned problems relating to the horizontally oriented extrusion screw.

The invention is defined by the appended independent claims. Preferred embodiments are set forth in the dependent claims and in the following description and drawings.

Hence, according to a first aspect, there is provided a continuous metal extruder comprising a rotatable member having an extrusion screw portion for transporting metal to be extruded in an axial direction of said rotatable member, a fixed part and a spring element for biasing the rotational member and the fixed part in relation to each other.

The continuous metal extruder further comprises a thrust bearing arranged between the rotational member and the fixed part. The thrust bearing may have a first bearing race facing the fixed part and a second bearing race facing a part of the rotatable member. The spring element may be arranged to bias the thrust bearing, and thereby the rotational member and the fixed part in relation to each other, by exerting along the axial direction an expanding force between the first race of the thrust bearing and the fixed part. The thrust bearing is movably mounted relative to the fixed part, and the spring element is able to exert an expanding force that is at least sufficient to move the thrust bearing when the thrust bearing is positioned horizontally.

According to a second aspect, there is provided a method in a continuous metal extruder. The method comprises providing a rotatable member having a screw portion for transporting metal to be extruded in an axial direction of the rotatable member, a fixed part; and a spring element for biasing the rotational member and the fixed part in relation to each other while the axial direction extends vertically, and subsequently turning the metal extruder so that the axial direction extends horizontally.

The method may further comprise providing a thrust bearing arranged between the rotational member and the fixed part. The thrust bearing may have a first bearing race facing the fixed part and a second bearing race facing a part of the rotatable member, and wherein the rotational member and the fixed part may be biased in relation to each other by exerting along the axial direction an expanding force between at least one of the following: the first race of the thrust bearing and the fixed part; and the second race of the thrust bearing and the part of the rotatable member.

By this the thrust bearing can be kept biased in all situations and undesirable separation of thrust bearing parts be obviated in situations when no extrusion pressure is transmitted to the thrust bearing. It is understood that the above mentioned extruder is one example of an extruder adapted to carry out the method.

Said part of the rotatable member may be a circumferential radial protrusion of the rotatable member.

The rotatable member may extend in a non-vertical direction, preferably substantially horizontally.

The expanding force may be sufficient for axially biasing the thrust bearing when no extrusion pressure is transmitted to the extrusion screw portion, and preferably sufficient for axially biasing the thrust bearing both at temperatures directly after extrusion has stopped and at room temperature.

The expanding force may be sufficient for axially biasing the thrust bearing so that the thrust bearing become able to radially support the rotatable member and thereby counteract tilt of and balance the rotatable member at non-extrusion.

The spring element may have at least one end arranged in a recess, the spring element being compressible fully into said recess by pressure transmitted to the extrusion screw portion during extrusion. The thrust bearing races can thus be supported during the extrusion by being in direct contact with the fixed part, e.g. a bearing housing, and the rotatable screw member.

The thrust bearing is typically a tapered roller bearing type of thrust bearing.

DESCRIPTION OF A PREFERRED EMBODIMENT

Figure 1A:
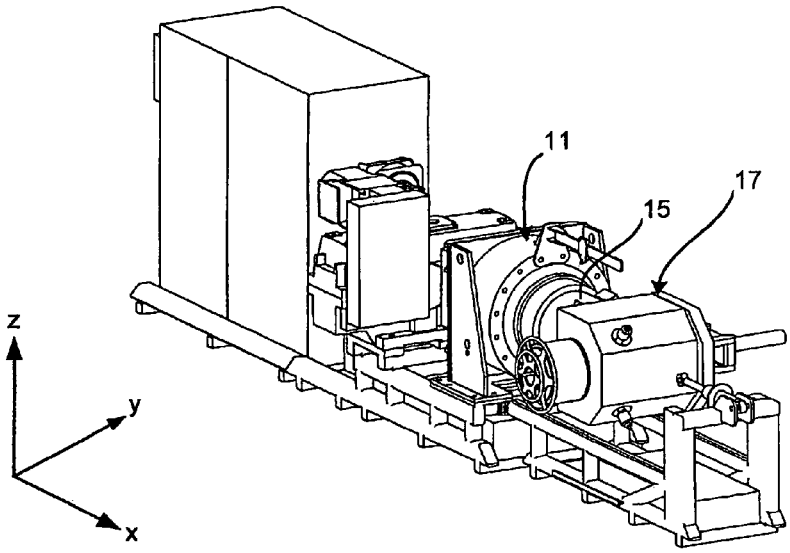
FIG. 1*a* is a perspective view of example embodiments.
Figure 1B:
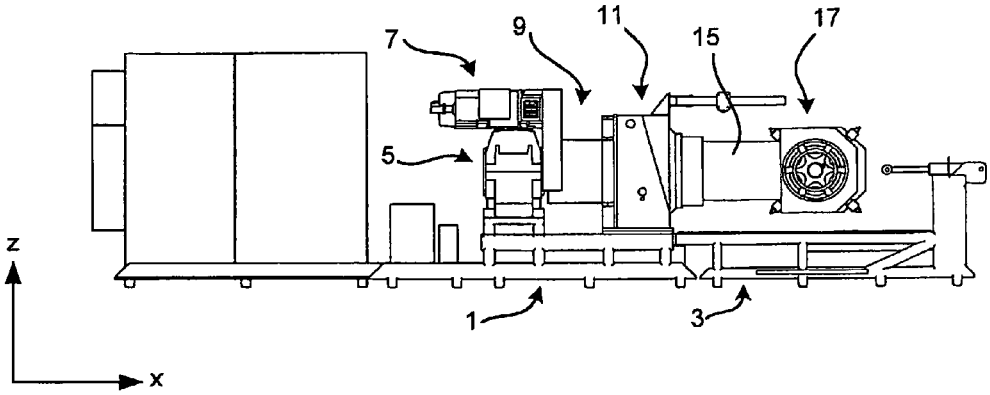
FIG. 1*b* is a side view of example embodiments.

FIGS. 1*a-b* show a perspective and side view, respectively, of an exemplary, HANSSON-ROBERTSON® type of continuous metal extruder that has been designed to be operated horizontally instead as vertically as previous machines. The shown extruder comprises a base frame 1 and a an extension frame 3 acting as floor support and means for bringing the parts of the extruder together. At least the base frame 1 is typically fixed to the floor on which the extruder is to be operated. The shown extruder further comprises a main motor assembly 7, a gear box 5, a coupling assembly 9, a bearing assembly 11, a screw housing 15 accommodating a liner 22 (not shown in FIGS. 1*a-b*) and a threaded extrusion screw 21 (not shown in FIGS. 1*a-b*), and a die block 17. Although not shown in FIGS. 1*a-b*, there are typically trolleys arranged to support the die block 17 and screw housing 15 on the extension frame 3 and to facilitate mounting/demounting of these parts. The shown extruder is arranged to transport the metal for extrusion horizontally (in the x-direction indicated in FIGS. 1*a-b*), instead of vertically as in previous designs.

Figure 2A:
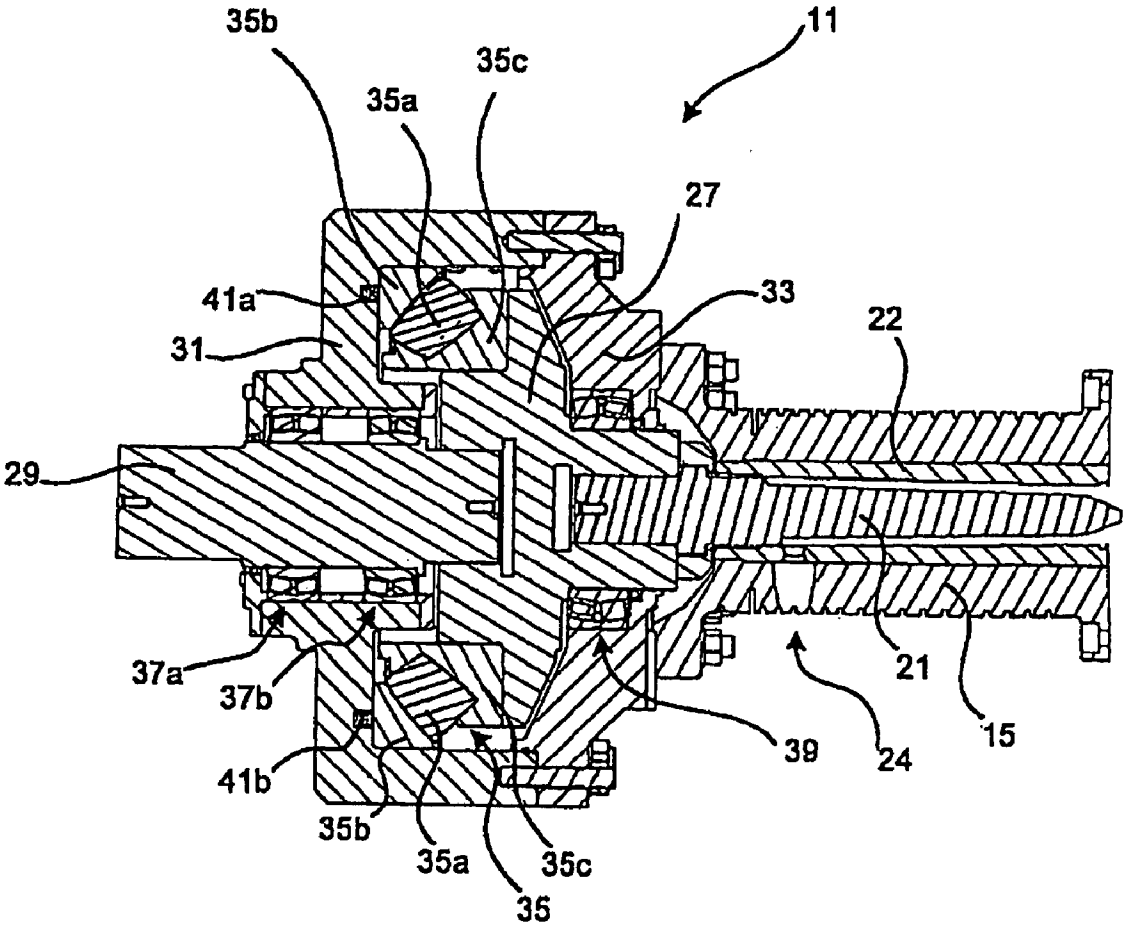
FIG. 2*a* illustrates a cross sectional side view extending vertically of the bearing housing and adjoining parts in FIGS. 1*a*-1*b*.
Figure 2B:
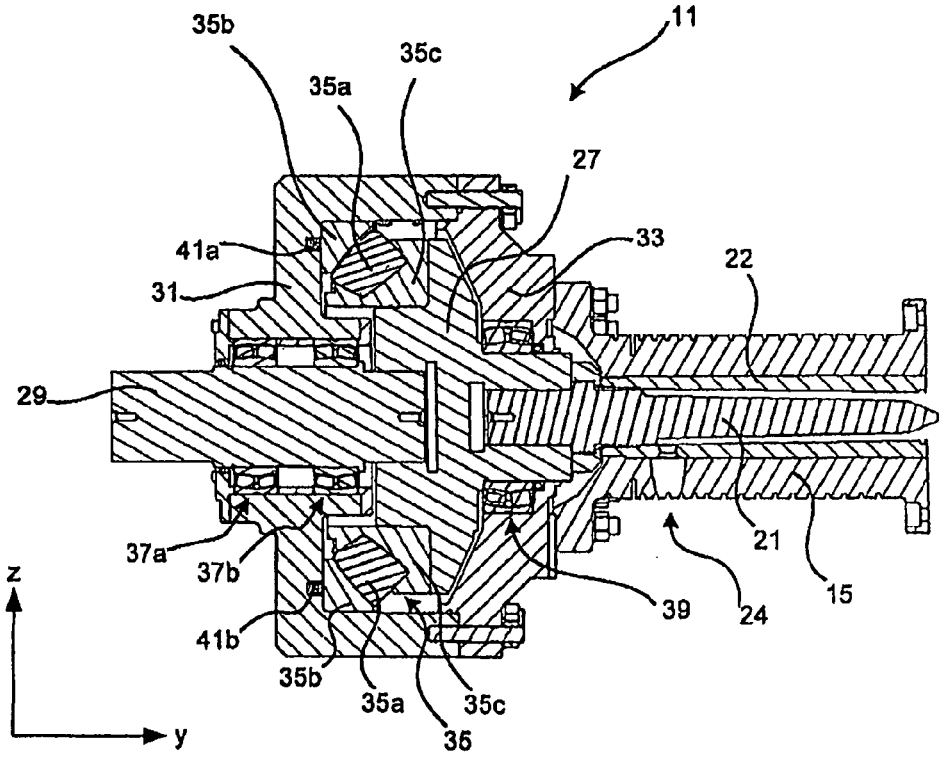
FIG. 2*b* illustrates a cross sectional side view extending horizontally of the bearing housing and adjoining parts in FIGS. 1*a*-1*b*.

FIG. 2 shows a cross sectional side view of the bearing housing 11 and adjoining parts in FIGS. 1*a-b*.

The general structure and function of the exemplifying extruder will now be briefly described. The main motor assembly 7 typically comprises an electrical motor for providing a driving force to the extrusion screw 21. In the shown example, the driving force is provided via a transmission shaft (not shown) of the gear box 5, to a coupling (not shown) in the coupling assembly 9, which coupling transfers the force to a shaft 29 extending into the bearing assembly 11. In the bearing assembly 11, the force is coupled to the extrusion screw 21 via a radially protruding coupling part 27 to which the extrusion screw is mounted. A melting pot (not shown) is arranged to feed melted metal, typically an alloy, via feed pipes (not shown) into an inlet 24 to the screw housing 15. There are arranged temperature control means (not shown) for cooling and heating the metal in the screw housing, i.a. in order to keep the metal in a state, typically plastic, where it can be transported under controlled high pressure by the screw 21 in cooperation with the liner 22. The screw is only supported at one end at the bearing assembly 11. The opposite, downstream, end of the screw, terminates at an inlet (not shown) to the die block 17. The shown die block 17 is arranged for extrusion into cable sheet. It is understood that the die block is replaceable by other type of die blocks, e.g. for extrusion into something else than cable sheet.

The structure and function of the arrangement shown in FIG. 2 will now be described in some detail. The shown bearing assembly 11 comprises a bearing housing 31, which can be seen mounted to the base frame 1 in FIGS. 1*a-b*. The bearing housing 31 is closed in the end facing the screw 21 by a bearing housing lid 33 to which the screw housing 15 is mounted and through which the screw 21 extends into the bearing housing 31. The bearing assembly 11 further comprises a thrust bearing 35, accommodated in the bearing housing, and which comprises a first bearing race 35*b*, a second bearing race 35*c* and bearing rollers 35*a* arranged between the races 35*b-c*. In the shown example, the thrust bearing 35 is a tapered roller bearing type of thrust bearing, but can in other embodiments be of a different type. The screw 21, the radially protruding coupling part 27 and the shaft 29, constitute a rotatable member. The radially protruding coupling part 27 is arranged to load the thrust bearing during extrusion by transmitting extrusion pressure from the screw to the thrust bearing races 35*c*. During extrusion, the axial forces transmitted to the thrust bearing (in the shown negative x-direction) by the rotatable member 21, 27, 29 have the effect of pressing the thrust bearing 35 towards and against the inside of the bearing housing 31. The bearing housing 31 is fixed and acts as a stop for further movement of the thrust bearing 35 in that direction. In an alternative embodiment there may be some other part than the bearing housing 31 that is arranged to support the pressing forces exerted upon it by the thrust bearing 35, for example a separate support mounted to the base frame and extending into the bearing housing 31. To support rotation of and to balance the rotatable member 21, 27, 29 when it rotates during extrusion, there is arranged ball bearings 37*a-b*, 39 in circumferential contact with, respectively, the shaft 29 and the radially protruding coupling part 27.

FIG. 2 shows a situation where the thrust bearing is pressed against an inner wall of the bearing housing 31, which for example is the situation during extrusion. However, to load the thrust bearing 35 when there is no extrusion pressure there are arranged spring elements 41*a*, 41*b*, here in the form of helical springs, between the inner wall of the bearing housing 31 and the first race 35*b* of the thrust bearing 35. When the thrust bearing 35 is pressed against the inner wall, as in the shown example of FIG. 2, the springs 41*a*, 41*b* are pressed into a respective recess in bearing housing 31. Although only two springs 41*a*, 41*b* are visible in the example of FIG. 2, there is a larger number of such springs in fact distributed evenly along the ring formed contact surface between the thrust bearing 35 and the bearing housing 31. However, the exact number of springs are typically of less importance, although it for balance reasons typically is required a number of distributed springs 41*a*, 41*b*. It is also possible with fewer springs 41*a*, 41*b*, for example one or more spring elements that each extends along larger portions of the, or along the whole, contact surface between the bearing housing 31 and the thrust bearing 35.

Generally, spring elements 41*a*, 41*b*, should be designed to be able to load and bias the thrust bearing when there is no extrusion pressure transmitted to the trust bearing. As a result separation of the thrust bearing parts 35*a-c* can be prevented in non-extrusion situations.

Due to differences in axial thermal expansion between parts in the bearing housing 31, there will, at some operation temperatures typically, be a maximum play formed, within which the thrust bearing is able to move. At which exact temperature the maximum play occurs is i.a. determined by the materials and dimensions of the involved parts. However, typically the maximum play will occur at the maximum or minimum temperature in the bearing housing. This is normally the highest temperature reached in the bearing housing 31 during extrusion or the lowest temperature reached at standby or shut-down of the extruder (typically the ambient temperate of the extruder, or room temperate, i.e. about 20° C.). In one example the maximum play is about 1 mm. The springs 41*a*, 41*b* in the shown example are designed to be able to load the thrust bearing 35 also in a situation of maximum play.

To be able to bias or load the thrust bearing 35, typically means that the spring elements 41*a*, 41*b* should be able to exert an expanding force that is at least sufficient to support the weight of the thrust bearing 35 and/or axially move the thrust bearing 35, or at least substantial parts thereof, when the thrust bearing is mounted inside the bearing housing 31 and positioned horizontally.

The thrust bearing parts 35*a-c* are in the present embodiment unattached to each other and unattached to the parts in contact with the races, i.e. here the bearing housing 31 and the radially protruding coupling part 27.

To facilitate mounting of the thrust bearing and reduce the risk of the thrust bearing parts coming apart when the bearing assembly 11 is assembled vertically and then turned horizontally, the spring elements 41*a*, 41*b* should be able to provide a force sufficient to support the weight of the thrust bearing 35 and typically also parts of the rotatable member 21, 27, 29 that are involved in loading the thrust bearing 35 when the assembly 11 is vertically positioned. In the shown example these parts involves at least the radially protruding coupling part 27, which is locked in place inside the bearing housing 31, and typically also the shaft 29. The screw 21 is typically being mounted after the bearing housing has been turned horizontally and already is mounted to the extruder. The expanding force exerted by the spring elements 41*a*, 41*b* thus have the effect of obviating relative axial movement between the involved parts inside the bearing housing when the bearing assembly 11 is turned from its vertical assembling position to its horizontal operative position.

To obviate separation of the thrust bearing 35 parts inside the bearing housing 31 of an assembled horizontal extruder in a non-extrusion situation, the springs 41*a*, 41*b* should be able to move the thrust bearing 35 horizontally when it is mounted inside the bearing housing 31. In other embodiments, however, the second thrust bearing race 35*c* may be mounted to the radially protruding coupling part 27 and it is then thus sufficient that the spring elements 41*a*, 41*b* are able to move only the first race 35*b* and the bearing roller 35*a* so that these can be pressed to the second race 35*c*, for example in the event of temperature caused axial expansion resulting in that the radially protruding part 27 and the second race 35*c* move away from the rest of the thrust bearing 35.

When there is no extrusion pressure and the rotatable member 21, 27, 29 is not pressed to and transmitting extrusion pressure to the thrust bearing 35, gravitational forces acting radially upon the screw end portion of the rotatable member 21, 27, 29 result in a momentum and forces acting so as to tilt the screw end portion of rotatable member downwards. In one embodiment the springs 41*a*, 41*b* are designed to bias and exert a loading force on the thrust bearing 35 that is sufficient for the thrust bearing 35 to be able to radially support and balance the rotatable member 21, 27, 29 and by that unload other parts of the bearing assembly 11, such as the roller bearings 39, which else have to provide the radial support.

It is understood that the springs 41*a*, 41*b* should be designed to be able to provide the desired thrust bearing load for all temperatures that the springs 41*a*, 41*b* are being subjected to in bearing housing 31. In the case of a lead extruder the maximum temperature is about 150° C.

Based on the above teachings, for example after finding out the maximum play and the desirable, or required, expansion force to be provided by the springs 41*a*, 41*b*, the skilled person will be able to design or find springs of suitable size and properties.

In the shown example the springs 41*a*, 41*b* are arranged to exert an expanding force between the bearing housing 31 and the first race 35*b* of the thrust bearing 35. However, it should be realized that, in other embodiments, there may be spring elements 41*a*, 41*b* arranged to exert an expanding force alternatively, or additionally, also between the radially protruding coupling part 27 and the second thrust bearing race 35*c*.

Although helical springs are shown in FIG. 2, and such springs typically are desirable due to their simplicity, it is realized that also other type of spring elements can be used. It is understood that any spring element that is able to exert the above kind of expanding force may be used. Non limiting examples of alternative, or supplementary, spring elements include gas springs, leaf springs, compression springs, pressure springs, cup springs, spiral springs, coil springs etc. It is also possible with more non-conventional spring elements, such as a hydraulic solution where e.g. the expanding force is formed by hydraulic pressure being applied in a sealed space between a part of the bearing housing and the first thrust bearing race.

In the shown example, the rotatable member 21, 27, 29 is formed of separate parts that have been mounted together. In alternative embodiments there may be other parts and/or more or less parts that forms a corresponding rotatable member. For example, it is possible, to have a single piece rotatable member, although this, of manufactural, assembly and maintenance reasons, is typically not desirable.

The drawings and the foregoing description are to be considered exemplary and not restrictive. The invention is not limited to the disclosed embodiments.

The present invention is defined by the claims and variations to the disclosed embodiments can be understood and effected by the person skilled in the art in practicing the claimed invention, for example by studying the drawings, the disclosure and the claims. Occurrence of features in different dependent claims does not exclude a combination of these features.

The invention claimed is:

1. A continuous metal extruder, comprising:

a rotatable member having an extrusion screw portion for transporting metal to be extruded in an axial direction of said rotatable member, a fixed part, a spring element for biasing the rotatable member and the fixed part in relation to each other, and a thrust bearing arranged between the rotatable member and the fixed part, said thrust bearing having a first bearing race facing said fixed part and a second bearing race facing a part of said rotatable member, wherein said spring element is arranged to provide an expanding biasing force, in said axial direction, between the first bearing race of the thrust bearing and the fixed part, wherein the entire thrust bearing is axially movably mounted relative the fixed part, and wherein the spring element is able to exert said expanding biasing force so as to provide at least a sufficient force to move the thrust bearing when the thrust bearing is positioned horizontally.

2. The continuous metal extruder as claimed in claim 1, wherein said part of the rotatable member is a circumferential radial protrusion of the rotatable member.

3. The continuous metal extruder as claimed in claim 1, wherein the rotatable member extends in a non-vertical direction.

4. The continuous metal extruder as claimed in claim 3, wherein the rotatable member extends substantially horizontally.

5. The continuous metal extruder as claimed in claim 1, wherein the expanding force is sufficient for axially biasing the thrust bearing when no extrusion pressure is transmitted to the extrusion screw portion.

6. The continuous metal extruder as claimed in claim 5, wherein the expanding force is sufficient for axially biasing the thrust bearing both at temperatures directly after extrusion has stopped and at room temperature.

7. The continuous metal extruder as claimed in claim 1, wherein the expanding force is sufficient for axially biasing the thrust bearing so that the thrust bearing becomes able to radially support the rotatable member, thereby balancing the rotatable member and counteracting tilt thereof when no extrusion pressure is transmitted to the extrusion screw portion.

8. The continuous metal extruder as claimed in claim 1, wherein the spring element has at least one end arranged in a recess, the spring element being compressible fully into said recess by pressure transmitted to the extrusion screw portion during extrusion.

9. The continuous metal extruder as claimed in claim 1, wherein the thrust bearing is a tapered roller bearing type.

* * * * *